US006943742B2

(12) United States Patent
Holly

(10) Patent No.: US 6,943,742 B2
(45) Date of Patent: Sep. 13, 2005

(54) FOCAL PLANE ARRAY FOR THZ IMAGER AND ASSOCIATED METHODS

(75) Inventor: Sandor Holly, Woodland Hills, CA (US)

(73) Assignee: The Boeing Company, Chicago, IL (US)

( * ) Notice: Subject to any disclaimer, the term of this patent is extended or adjusted under 35 U.S.C. 154(b) by 3 days.

(21) Appl. No.: 10/780,535

(22) Filed: Feb. 16, 2004

(65) Prior Publication Data

US 2005/0179606 A1 Aug. 18, 2005

(51) Int. Cl.[7] ..... H01Q 19/06

(52) U.S. Cl. ..... 343/753; 343/814; 343/909

(58) Field of Search ..... 343/753, 754, 343/756, 793, 814, 820, 909

(56) References Cited

U.S. PATENT DOCUMENTS

| | | | | |
|---|---|---|---|---|
| 3,348,093 A | | 10/1967 | Holly | |
| 5,089,828 A | * | 2/1992 | Moss | 343/725 |
| 5,420,595 A | | 5/1995 | Zhang et al. | |
| 5,828,344 A | * | 10/1998 | Alder et al. | 343/755 |
| 5,856,803 A | | 1/1999 | Pevler | |
| 6,084,552 A | * | 7/2000 | Robertson et al. | 343/753 |
| 6,195,058 B1 | * | 2/2001 | Nakamura et al. | 343/753 |
| 6,864,825 B2 | | 3/2005 | Holly | |

FOREIGN PATENT DOCUMENTS

| | | | | |
|---|---|---|---|---|
| GB | 2251519 A | * | 7/1992 | H01Q 3/26 |
| GB | 2260447 A | * | 4/1993 | H01Q 1/38 |

OTHER PUBLICATIONS

Peter H. Siegel, *Terahertz Technology, IEEE Transactions on Microwave Theory and Techniques*, Mar. 2002, pp. 910-928, vol. 50.

Peter H. Siegel, *THz Technology: An Overview, International Journal of High Speed Electronics and Systems*, 2003, pp. 1-44, vol. 13—No. 2, World Scientific Publishing Company, USA.

Sanjay Raman, N. Scott Barker, and Gabriel M. Rebeiz; *A W-Band Dielectric-Lens-Based Integrated Monopulse Radar Receiver*; IEEE Transactions on Microwave Theory and Techniques; Dec. 1998; pp. 2308-2316; vol. 46, No. 12.

Daniel F. Filipovic, Gildas P. Gauthier, Sanjay Raman, and Gabriel M. Rebeiz; *Off-Axis Properties of Silicon and Quartz Dielectric Lens Antennas*; IEEE Transactions on Antennas and Propagation; May 1997; pp. 760-766; vol. 45, No. 5.

* cited by examiner

*Primary Examiner*—Tho Phan
(74) *Attorney, Agent, or Firm*—Alston & Bird LLP

(57) ABSTRACT

A high-frequency imaging system for the millimeter and submillimeter radiation includes a high frequency lens to image an object at its focal plane. The object emits electromagnetic radiation at a first frequency above the microwave band of the electromagnetic spectrum. A local oscillator generates an electromagnetic beam at a second frequency to illuminate a plurality of dual-frequency antennas at the focal plane of the lens. Intermodulation of first and second frequencies generates a signal distribution of a third frequency over the focal plane, which represents an image. Also, a method of providing an image at the third frequency of an object emitting electromagnetic radiation at a first frequency is provided. The method includes imaging the electromagnetic radiation at the first frequency from each point of the object onto the focal plane. An electromagnetic beam is transmitted to illuminate all elements of the focal plane array.

27 Claims, 4 Drawing Sheets

FOCAL PLANE ARRAY FOR THZ IMAGER AND ASSOCIATED METHODS

FIELD OF THE INVENTION

The present invention relates to a high frequency imaging system, and more particularly, to a high-frequency imaging system including a dual-frequency antenna and associated method for imaging an object at a difference frequency.

BACKGROUND OF THE INVENTION

There is an ever increasing need for focal plane arrays to be used in imaging cameras that work in the Terahertz regime of the Electromagnetic Spectrum. There are large number of applications in THz imaging that await the arrival of an imager having the attributes such as high sensitivity, high resolution, well-known spectral characteristics, size, etc. Imaging in the THz regime may have applications to viewing through some obstacles that are otherwise opaque to the visible, UV, infrared and x-ray segments of the spectrum. Therefore, this is may be an important application area in the areas of national security, homeland defense, etc. Microwave imaging technology (even though the radiation used may penetrate and transmit through opaque barriers, such as cloths, wooden crates, etc.) is not always adequate because of poor resolution due to long wavelength of the microwaves used. Many such applications and proposed methods for implementation are described by P. H Siegel in "THz Technology: An Overview" IEEE Transactions On Microwave Theory and Techniques, March 2002, pp. 910–928, reprinted in International Journal of High Speed Electronics and Systems, Vol. 13, No. 2 (2003) pp. 351–394. Therefore there is a need in the art for high frequency imaging applications particularly in the THz regime of the EM spectrum.

As used herein, several terms should first be defined. By definition, microwaves are the radiation that lie in the centimeter wavelength range of the EM spectrum (in other words: $1<\lambda<100$ cm, that is, the frequency of radiation in the range between 300 MHz and 30 GHz, also known as microwave frequencies). Electromagnetic radiation having a wavelength longer then 1 meter (or frequencies lower then 300 MHz) will be called "Radio Waves" or just "Radio Frequency" (RF). For simplicity in this disclosure, the RF spectrum is considered to cover all frequencies between DC (0 Hz) and 300 MHz. Millimeter Waves (MMW) are the radiation that lie in the range of frequencies from 30 GHz to 300 GHz, where the radiation's wavelength is less than 10 millimeters. Finally, electromagnetic frequencies from 300 GHz to 30 THz are described as submillimeter waves, or terahertz frequencies. Anything above 30 THz are considered as optical frequencies (or wavelengths), which includes infrared (1R) and visible wavelengths. The optical range is divided into bands such as infrared, visible, ultraviolet. For purposes of this disclosure, millimeter and submillimeter frequencies are described throughout, however, these same principles apply to submillimeter and smaller (higher frequency wavelengths), therefore submillimeter, as used herein, can include optical frequencies. As known to those of ordinary skill in the art, for practical purposes the "borders" for these above these frequency ranges are often not precisely observed. For example, a cell phone antenna and its circuitry, operating in the 2.5+GHz range is associated with RF terminology and considered as part of RF engineering. A waveguide component for example, covering the Ka band at a frequency around 35 GHz is usually called a microwave (and not a MMW) component, etc. Accordingly, these terms are used for purposes of consistently describing the invention, but it will be understood to one of ordinary skill in the art that alternative nomenclatures may be used in more or less consistent manners.

SUMMARY OF THE INVENTION

According to one embodiment of the invention, a high-frequency imaging system comprises a high frequency lens to form an image of an object at a focal plane. The object emits or reflect electromagnetic radiation at a first frequency above the microwave band of the electromagnetic spectrum. A local oscillator generates an electromagnetic beam at a second frequency, which is higher than the first frequency, to illuminate a plurality of dual-frequency antennas, which are arrayed at the focal plane of the lens. Each element of the focal plane sensor array, a dual frequency antenna in itself, is also arrayed to an effective length to receive the electromagnetic radiation at the first frequency. The dual-frequency antenna typically comprises a plurality of dipole antennas, each antenna being configured to receive the electromagnetic radiation both from the image field and from a local oscillator (LO) frequency. The dipoles, according to one aspect of the invention, may be connected by a nonlinear resonant circuit to permit intermodulation of the first and second frequency. The intermodulation generates a signal of a third frequency, which represents the new image at or the dual-frequency antenna or which can be viewed by commercially available IR viewing devices.

According to another embodiment of the invention, a method of providing an image of an object emitting electromagnetic radiation comprises focusing the electromagnetic radiation from the object to a focal plane. The object emits electromagnetic radiation at a first frequency. An electromagnetic beam is transmitted at a second frequency offset from the first frequency by a difference frequency. This second electromagnetic beam and the object's electromagnetic radiation are both received by a two dimensional array of dual-frequency antennas disposed in the focal plane. Each dual-frequency antenna includes the necessary number of dipole antennas configured in a linear string to resonate as a half-wave dipole at the first frequency of the image. The first and second frequencies both resonate in the antenna and will be converted into a signal distribution at the difference frequency by intermodulation thereby providing an image.

BRIEF DESCRIPTION OF THE DRAWINGS

Figure 1:
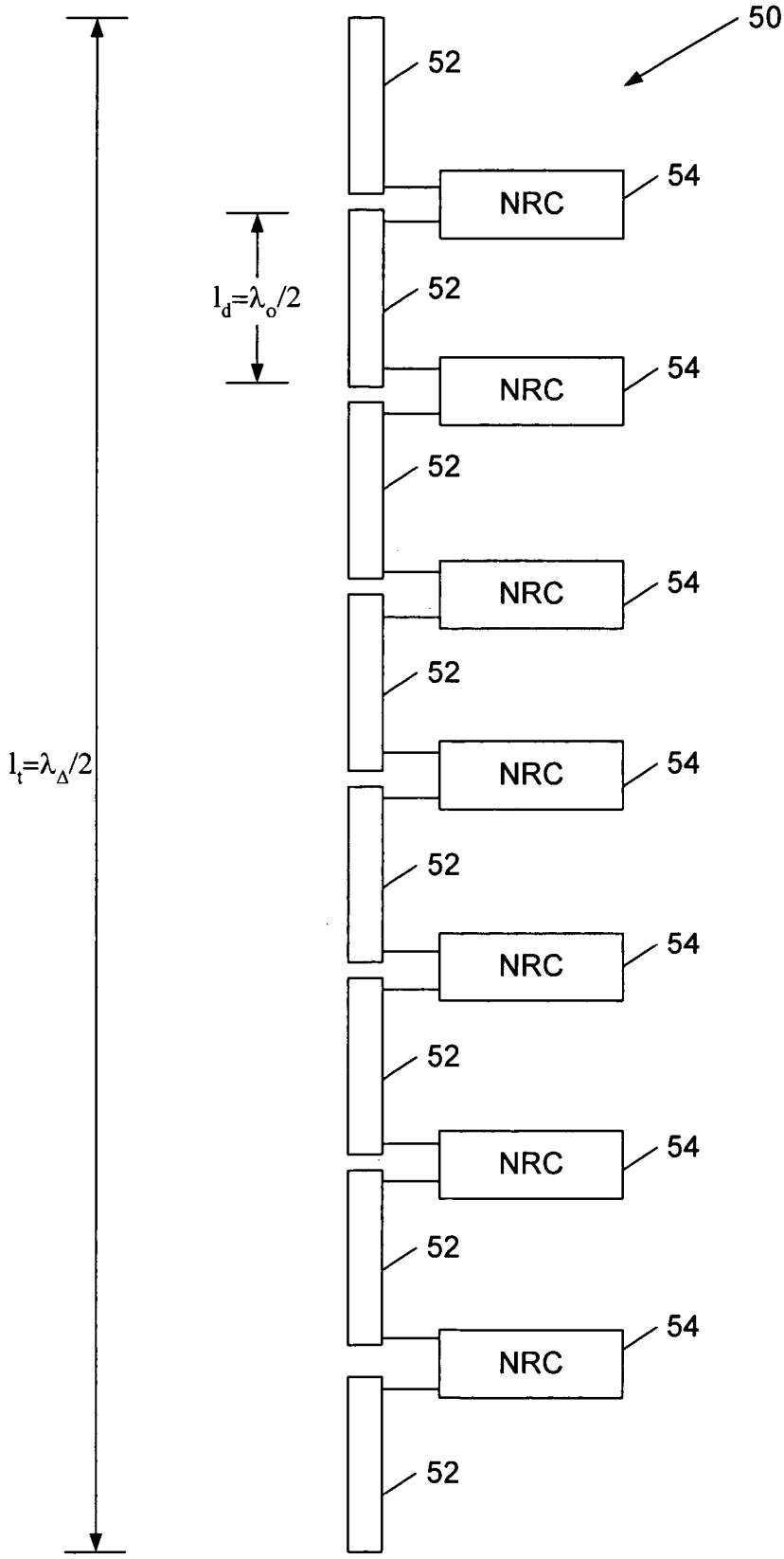
Figure 2B:
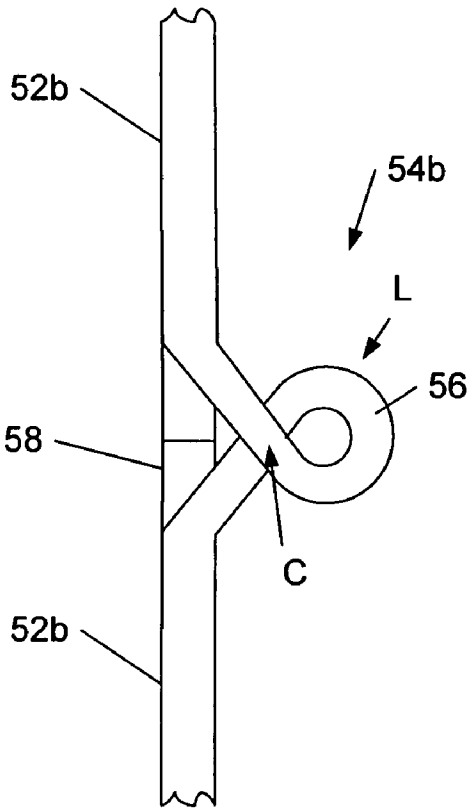
Figure 2A:
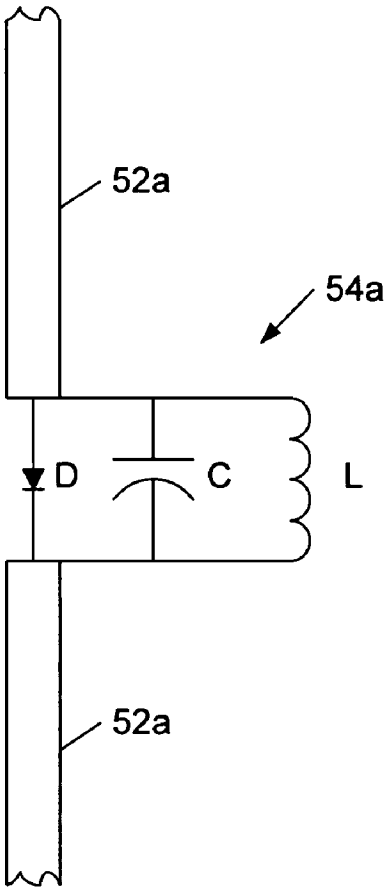
Figure 3:
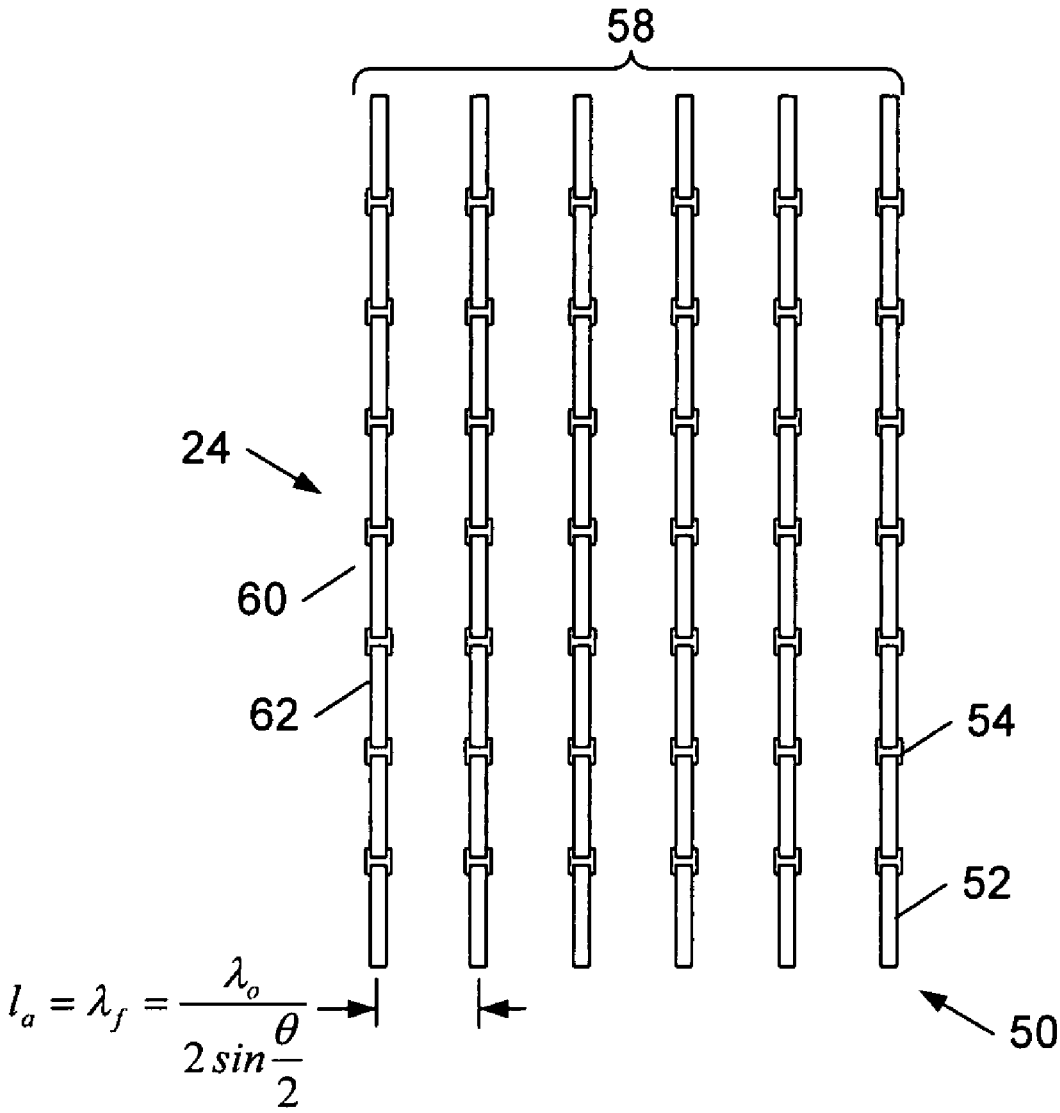
Figure 4:
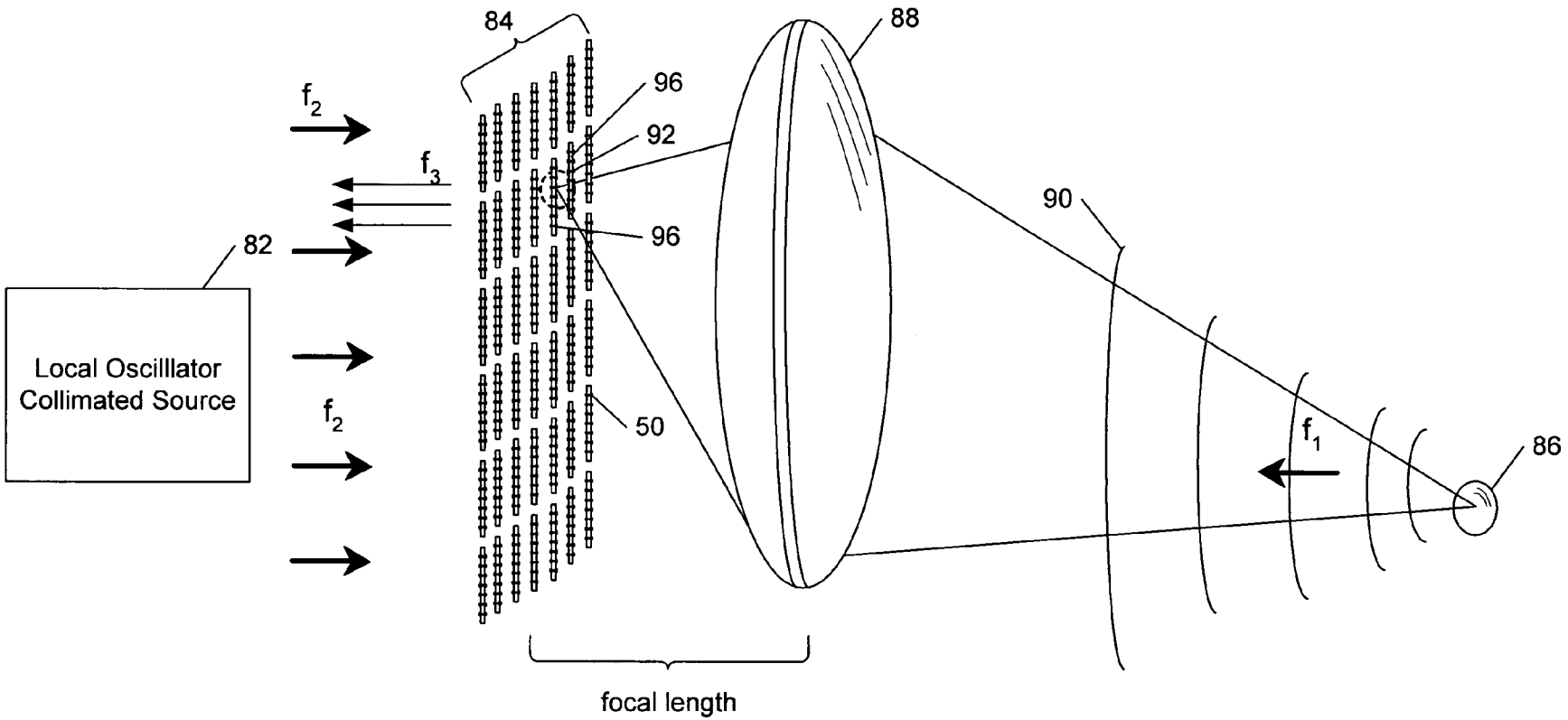

Having thus described the invention in general terms, reference will now be made to the accompanying drawings, which are not necessarily drawn to scale, and wherein:

FIG. 1 is a plan view of a plurality of dipole antennas interconnected by nonlinear resonant circuits according to one embodiment of the present invention;

FIGS. 2(*a*) and (*b*) are schematic diagrams showing details of a simple nonlinear resonant circuit connecting to the tips of two consecutive dipole antennas tips according to one embodiment of the present invention;

FIG. 3 is a schematic front view of a nonlinear dual frequency two-dimensional antenna array used as a focal plane sensor array for a low frequency image; and FIG. 4 is a schematic perspective of a high frequency imaging system incorporating a two-dimensional nonlinear dual-frequency focal plane antenna according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Electromagnetic radiation in the RF (radio frequency), microwave, millimeter and optical wave ranges interacts with thin conducting bodies, such as wires when the conductor is aligned with the electric field of radiation. The interaction is dependent upon conductor electrical length length, l, in relation to the radiation wavelength, λ. A half wavelength dipole antenna, for example, will resonate and reradiate for a conductor electrical length that is one half the radiation wavelength. For any such antenna, the antenna converts the electromagnetic wave to an induced voltage and current. The intermodulation function of the diode converts the two frequencies to their sum and difference frequencies. Dipole antennas and nonlinear resonant circuits placed in the intersection of beams as elements of the two-dimensional array can be employed to reradiate primarily the difference frequency. One way of doing that is to tune the resonant circuits to selectively resonate the difference frequency.

A dual-frequency antenna is described in co-pending U.S. Patent Application No. 10/780,525 entitled "Dual-Frequency Antenna And Associated Down-Conversion Method"; Ser. No. 10/780,520 entitled "Two-Dimensional Dual-Frequency Antenna And Associated Down-Conversion Method"; and Ser. No. 10/780,536 entitled "High-Frequency Two-Dimensional Antenna And Associated Down-Conversion Method," all of which are filed concurrently herewith, and all of which are incorporated herein by reference in their entirety. A dual-frequency antenna comprises of a "string of dipoles" that are lined up in a line. These individual dipoles are connected at their ends with the matching resonant circuits. These circuits include a nonlinear element, such as a diode. In accordance with their purpose, the dual-frequency antennas are made to resonate at different frequencies. The connecting circuits are designed and made to behave as open circuits for the higher frequency and quasi-short circuits at the lower of the frequencies. One method of use includes down-converting two high frequencies—incident on this dipole assembly into a difference frequency, which can be reradiated in a given direction. Various embodiments of this method and corresponding apparatuses are described in aforesaid co-pending applications.

If we consider one of these dual frequency antennas as one element of a two-dimensional array, then this array can be designed to produce a collimated difference frequency beam with close to diffraction limited quality. The present disclosure describes a concept which uses the same nonlinear dipole array configuration as was proposed in the earlier disclosures to generate a difference frequency. However, the present invention includes a detector array for Terahertz images that are created in a focal plane of a Terahertz lens. In this case each dual-frequency antenna assembly serves as a pixel sensor. A "local oscillator" high frequency beam illuminates the same focal plane array—which is positioned at the focal plane of the Terahertz lens from either the front or from the back.

Referring to FIG. 1 and one embodiment of the invention, a dual frequency nonlinear antenna 50 can reradiate electromagnetic radiation at the difference frequency by employing nonlinear resonant circuits (NRC) 54 interconnecting multiple antennas 52. The nonlinear resonant circuits 54 are frequency selective, providing open circuit conditions at the high frequencies (supplied by the local oscillator (LO)) at which the individual dipoles 52 are resonant, while these circuits become quasi short circuits at the low frequencies). The nonlinear resonant circuits thereby connect the individual dipoles 52 together to form a half-wave dipole—at each array element location—that is resonant at the long wavelength radiation of the image field. In this embodiment, a dual frequency nonlinear antenna 50 comprises a plurality of dipole antennas 52 interconnected by nonlinear resonant circuits 54 that couple frequencies of the antennas. The dual frequency nonlinear antenna 50 can be designed and built to convert the interfering waves of any combination of beams with frequencies, $f_1$ and $f_2$. The electrical length, $l_d$, of each dipole antenna 52 is equal to one-half the wavelength of the radiation generated by the L0, the total electrical length, $l_t$, of the dual frequency nonlinear antenna 50 is one half the wavelength of the radiation with frequency f1 of the (THz) image.

In one embodiment illustrated in plan view of FIG. 2(*b*), a nonlinear resonant circuit 54*b* may comprise a conductive planar loop 56 and p-n junction 58 or a Schottky diode deposited on a substrate with a layer of insulation, such as a substrate of silicon with an oxide layer on top ($SiO_2$) by using lithographic manufacturing techniques. In order to obtain the resonant qualities of an antenna as described in the example above, the capacitance and inductance would be quite small. Depending upon the resonance frequency desired, a small one turn conductive planar loop 56 (or just a fraction of a loop) is all that is needed in order to facilitate fabrication of a high frequency, resonant circuit using standard monolithic deposition techniques. As an example at extremely high frequencies, a capacitive values of one femtoFarad is typical to obtain resonance at 30 THz frequency (wavelength is 10 micron). Conductive material, such as aluminum or other conductive materials, is looped to form an inductive element, L, while opposite ends of the loop are overlaid with an insulator therebetween, such as aluminum oxide, to form a parallel plate capacitive element C. In this regard, the inductive and capacitive properties are controlled by the dimensions of the loop and the oxide layer thickness in order to obtain the appropriate values of inductance and capacitance. The diode 58 may be formed in a number of different ways, such as creating a metal-oxide-metal (MOM) sandwich, which forms a tunneling junction diode (such as Nickel-NiO-Nickel) if the oxide layer thickness is kept 50 Å or less (and that thickness is carefully controlled). Schottky planar diodes or the Schottky "cat-whisker" type diodes for very high THz frequencies is an example of other types of diodes like linearly adjacent regions formed of p and n material in accordance with monolithic manufacturing techniques. Likewise, the dipole antennas 52*b* may also be disposed and comprised of materials such as aluminum, gold, silver, cooper, nickel etc. to facilitate deposition in combination with the planar conductive loop 56. The foregoing is illustrative of one embodiment of a dual frequency dipole antenna 50 comprising half-wavelength electric dipole antennas 52 effectively arrayed to achieve a dual frequency half-wavelength electric dipole antenna.

Referring now to FIG. 3, the dual-frequency antenna 50 will be provided in an arrayed plurality of dual-frequency antennas forming a two-dimensional dual-frequency antenna 58. As shown, each dual frequency dipole antenna of the two-dimensional antenna is separated from adjacent dual-frequency antenna columns by a distance, $l_a$.

Referring to FIG. 4 and according to another embodiment of the invention, a dual frequency antenna may also be provided in two or three dimensions in a focal plane array 84. At high frequency, in particular, a dual frequency focal plane array may be employed for high frequency imaging, such as in the Terahertz regime of the electromagnetic spectrum. High frequency imaging may permit improved sensitivity, resolution, and spectral characteristics compared to microwave and millimeter wave imaging systems currently in existence. Microwave and millimeter wave imaging systems, in particular, are limited in resolution due to the longer wavelength of electromagnetic beams used in these applications.

In FIG. 4, a point (pixel) of an image 92 from a THz object 86 may be disposed at the focal plane of a Terahertz lens 88. Depicted in perspective, the two dimensional array 84 of dual frequency nonlinear dipole antennas 50 is disposed at the focal plane of the terahertz imaging lens, i.e., spaced from the lens by the focal length of the lens. Each dual frequency nonlinear dipole antenna 50 of the two dimensional array can be considered to be a sensor in a pixel relative to the image of the THz object 86. The dual frequency nonlinear dipole antenna is illuminated by two electromagnetic radiation patterns, one from the THz object 86 at a first frequency, $f_1$, and one from a local oscillator 82, which may be a collimated source, at a second frequency, $f_2$.

The local oscillator uniformly illuminates all "pixels," that is each dual frequency nonlinear dipole antenna 50, of the focal plane array creating a "bias resonance" corresponding to a high frequency resonance. The high frequency resonance, $f_2$, is the resonant frequency for the length of the individual dipole antenna (see 52 and $l_d$ FIG. 1), and may typically correspond to frequency in the near or far IR range. The illumination by the local oscillator 82 may be on either side of the array, but for convenience of positioning, it may be on the side opposed to the THz lens 88.

The THz object 86 illuminates the "pixels" about which it image is formed by the lens 88, typically by reflection of an electromagnetic THz beam (not shown) from another source (also not shown). The frequency, $f_1$, of the radiation from the THz object corresponds to the lower resonant frequency of the dual-frequency dipole antenna 50, that is the frequency corresponding to the total overall length (see $l_1$, FIG. 3). There are many alternative methods of providing an THz object, such as from a source itself, or re-radiation from a dipole antenna, as described above. The electromagnetic radiation from the THz object 86 is only relevant to the image, and not the manner or method of generating radiation from the electromagnetic source; and accordingly, those of ordinary skill in the art will recognize that many alternative THz objects may be utilized without departing from the scope of the present invention. Typical applications of this terahertz imaging concept will be grouped in two groups: active or passive. Active means that a light source emitting at the terahertz band in which the THz imager is designed to be sensitive. Passive applications are those in which the object either emits or reflects a THz frequency radiation.

The THz image 92, therefore, resonates the low frequency resonance of each dual frequency dipole antenna at the "pixels" corresponding to spatial variation of intensity of the electromagnetic radiation about the pixel. The "bias resonance" from the local oscillator 82 resonate the high frequency resonances throughout the focal plane. The difference frequency, the beat frequency, between the electromagnetic radiation patterns at the point of the image 92 therefore generates, through intermodulation, a difference frequency. In this regard, the dual frequency nonlinear dipole antennas are a two dimensional array of heterodyning receivers. The difference frequency, therefore, is re-radiated, as in the above examples and may used to view the image by receiving or reviewing the difference frequency. In particular, if the difference frequency is kept in the near IR range of the spectrum, the image may easily be viewed through numerous IR viewing techniques that are well known to those of ordinary skill in the art.

As an example, consider a THz object 86 emitting and/or reflecting electromagnetic (EM) radiation at $f_1$=0.64 THz (640 GHz)—the image frequency—and a local oscillator (LO) source 82 providing an electromagnetic beam at a frequency $f_2$=28.275 THz ($\lambda_2$=10.61 microns, which is a common $CO_2$ laser source frequency). The resulting difference frequency $f_3=\Delta f$=27.955 THz ($\lambda_\Delta$=10.856 microns) is in the IR band of the EM spectrum. Each dipole antenna 52 has an electrical length $l_d$=5.3 microns (i.e. $\lambda_2/2$, the LO half-wavelength). Also, the total effective (electrical) length of each dual frequency nonlinear dipole antenna 50 is half the wavelength of the THz radiation of the image $l_t$=234 microns (i.e. $\lambda_1/2$, where the wavelength of the terahertz radiation (0.64 THz) of the image field at the focal plane array is $l_1$=468 $\mu$m (i.e., $\lambda_\Delta/2$), which therefore represents a single pixel. Accordingly multiple pixels may be appropriately spaced to the desired resolution. While this example and FIG. 4 represent a two-dimensional array, additional dimensions may be added including additional array polarizations.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A high-frequency imaging system, comprising:

a high frequency lens configured to form an image of an object at a focal plane, the object emitting electromagnetic radiation at a first frequency above the microwave band of the electromagnetic spectrum;

a local oscillator configured to generate an electromagnetic beam at a second frequency, the second frequency being higher than the first frequency; and a plurality of dual-frequency antennas being arrayed to an effective length to receive the electromagnetic radiation at the first frequency, and configured to receive the electromagnetic beam at the second frequency, the dual frequency antennas configured to permit intermodulation of the first and second frequency generating a signal of a third frequency corresponding to the difference between the first and second frequencies, the signal representing the image.

2. The high-frequency imaging system according to claim 1, wherein each dual-frequency antenna comprises:

a plurality of dipole antennas; and a plurality of nonlinear resonant circuits, each nonlinear resonant circuit interconnecting at least two of the plurality of dipole antennas and configured to permit re-radiation of signals having the third frequency over the effective length.

3. The high-frequency imaging system according to claim 2, wherein each of the plurality of dipole antennas comprises a half-wavelength dipole.

4. The high-frequency imaging system according to claim 2, wherein each of the plurality of dipole antennas comprises an electric dipole.

5. The high-frequency imaging system according to claim 2, wherein the nonlinear resonant circuit comprises at least one reactive circuit element.

6. The high-frequency imaging system according to claim 5, wherein the at least one reactive circuit element comprises an inductive circuit element interconnecting at least two of the plurality of dipole antennas.

7. The high-frequency imaging system according to claim 6, wherein the inductive circuit element comprises a looped conductor.

8. The high-frequency imaging system according to claim 5, wherein the at least one reactive circuit element comprises a capacitive circuit element interconnecting at least two of the plurality of dipole antennas.

9. The high-frequency imaging system according to claim 8, wherein the capacitive circuit element comprises a parallel plate capacitor.

10. The high-frequency imaging system according to claim 2, wherein the nonlinear resonant circuit comprises at least one nonlinear circuit element interconnecting at least two of the plurality of dipole antennas.

11. The high-frequency imaging system according to claim 10, wherein the nonlinear circuit element comprises a diode.

12. The high-frequency imaging system according to claim 1, wherein the local oscillator comprises a collimated high-frequency source.

13. The high-frequency imaging system according to claim 1, wherein the plurality of dual-frequency antennas are two-dimensionally arrayed.

14. A high-frequency two-dimensional focal plane antenna, comprising:

a plurality of dual-frequency antennas being arrayed to an effective length to receive signals at a first frequency above the microwave band of the electromagnetic spectrum, and configured to receive signals having a second frequency, and, the dual-frequency antennas are configured to permit intermodulation of the first and second frequencies generating a signal of a third frequency corresponding to the difference between the first and second frequencies.

15. The high-frequency two-dimensional focal plane antenna according to claim 14, wherein each dual-frequency antenna comprises:

a plurality of dipole antennas; and a plurality of nonlinear resonant circuits, each nonlinear resonant circuit interconnecting at least two of the plurality of dipole antennas and configured to permit re-radiation of signals having the third frequency over the effective length.

16. The high-frequency two-dimensional focal plane antenna according to claim 15, wherein each of the plurality of dipole antennas comprises a half-wavelength dipole.

17. The high-frequency two-dimensional focal plane antenna according to claim 15, wherein each of the plurality of dipole antennas comprises an electric dipole.

18. The high-frequency two-dimensional focal plane antenna according to claim 15, wherein the nonlinear resonant circuit comprises at least one reactive circuit element.

19. The high-frequency two-dimensional focal plane antenna according to claim 18, wherein the at least one reactive circuit element comprises an inductive circuit element interconnecting at least two of the plurality of dipole antennas.

20. The high-frequency two-dimensional focal plane antenna according to claim 19, wherein the inductive circuit element comprises a looped conductor.

21. The high-frequency two-dimensional focal plane antenna according to claim 18, wherein the at least one reactive circuit element comprises a capacitive circuit element interconnecting at least two of the plurality of dipole antennas.

22. The high-frequency two-dimensional focal plane antenna according to claim 21, wherein the capacitive circuit element comprises a parallel plate capacitor.

23. The high-frequency two-dimensional focal plane antenna according to claim 15, wherein the nonlinear resonant circuit comprises at least one nonlinear circuit element interconnecting at least two of the plurality of dipole antennas.

24. The high-frequency two-dimensional focal plane antenna according to claim 23, wherein the nonlinear circuit element comprises a diode.

25. A method of providing an image of an object emitting electromagnetic radiation at a first frequency above the microwave band of the electromagnetic spectrum, comprising:

focusing the electromagnetic radiation from the object at a focal plane;

transmitting an electromagnetic beam at a second frequency above the microwave band of the electromagnetic spectrum and offset from the first frequency by a difference frequency;

receiving the electromagnetic beam and the electromagnetic radiation of the object at a high-frequency antenna comprising a plurality of dual-frequency antennas disposed in the focal plane, each dual-frequency antenna including at least two dipole antennas; and converting the first and second frequencies to a signal at the difference frequency through a nonlinear resonant circuit coupling the at least two dipole antennas, thereby providing an image.

26. The method according to claim 25, wherein the step of transmitting further comprises collimating the electromagnetic beam.

27. The method according to claim 25, further comprising, transmitting electromagnetic radiation at the first frequency such that the electromagnetic radiation is reflected by the object to provide the object image.

* * * * *